US008319159B2

(12) United States Patent
Ceraso

(10) Patent No.: US 8,319,159 B2
(45) Date of Patent: Nov. 27, 2012

(54) RADIANT PANEL OF ANODIZED ALUMINIUM WITH ELECTRIC RESISTANCE OF STAINLESS STEEL

(75) Inventor: Bruno Ceraso, Abizzate (IT)

(73) Assignee: Cedal Equipment Srl, Milan (IT)

( * ) Notice: Subject to any disclaimer, the term of this patent is extended or adjusted under 35 U.S.C. 154(b) by 1166 days.

(21) Appl. No.: 12/161,481

(22) PCT Filed: Mar. 1, 2006

(86) PCT No.: PCT/IT2006/000121

§ 371 (c)(1),
(2), (4) Date: Jul. 18, 2008

(87) PCT Pub. No.: WO2007/088562

PCT Pub. Date: Aug. 9, 2007

(65) Prior Publication Data

US 2010/0224622 A1 Sep. 9, 2010

(30) Foreign Application Priority Data

Feb. 3, 2006 (IT) ..... M12006A0180

(51) Int. Cl.
*H05B 3/06* (2006.01)
*H05B 3/08* (2006.01)

(52) U.S. Cl. ..... 219/540; 219/541

(58) Field of Classification Search ..... 219/538–548
See application file for complete search history.

(56) References Cited

U.S. PATENT DOCUMENTS

| | | | | |
|---|---|---|---|---|
| 3,265,858 | A * | 8/1966 | MacGuire | 392/435 |
| 3,423,574 | A | 1/1969 | Shomphe et al. | |
| 3,573,430 | A * | 4/1971 | Eisler | 219/385 |
| 4,860,434 | A | 8/1989 | Louison et al. | |
| 5,336,341 | A * | 8/1994 | Maejima et al. | 148/415 |
| 6,080,970 | A * | 6/2000 | Yoshida et al. | 219/444.1 |
| 6,415,104 | B1 | 7/2002 | Fitts et al. | |
| 7,372,001 | B2 * | 5/2008 | Tachikawa et al. | 219/468.1 |

FOREIGN PATENT DOCUMENTS

| | | | |
|---|---|---|---|
| EP | 0 755 170 | A2 | 1/1997 |
| FR | 2 580 887 | A1 | 10/1986 |
| WO | 01/35700 | A1 | 5/2001 |

* cited by examiner

*Primary Examiner* — Sang Paik
(74) *Attorney, Agent, or Firm* — Young & Thompson

(57) ABSTRACT

A panel for electric heating, with an outer hermetic aluminum shell, an inner shell with a rectangular base and a cover, inside which is an ohmic resistance in the shape of a planar serpentine, formed of a series of U-bends and having two pseudo-circular endings that extend to the inside of a hermetic contact module integrated with the outer shell, wherein the serpentine is made of a rigid bar having a rectangular section, wherein the base of the inner shell incorporates a thick layer of oxide that favors infrared irradiation, and wherein an internal thermal insulator hinders the flow of heat towards the cover.

14 Claims, 4 Drawing Sheets

ARTE NOTA (PRESENT STATE OF THE ART)

(Sez. A–A)

(Sez. B–B)

(Sez. C–C)

RADIANT PANEL OF ANODIZED ALUMINIUM WITH ELECTRIC RESISTANCE OF STAINLESS STEEL

FIELD OF APPLICATION

The present invention relates to heating by electricity and more particularly to a radiant panel of anodized aluminium with an electric resistance of stainless steel.

PRESENT STATE OF THE ART

The branch of technology referred to already comprises radiant panels for domestic heating purposes or for industrial furnaces operating at considerably higher temperatures. These panels utilize the Joule effect expressed by the formula $Q=R\times I^2\times t$ by means of which the Q quantity of heat generated is related to the electric current I that, through an electric resistance conductor R for a length of time t, is heated due to increased impacts caused by the higher average speed of the electrons.

The heat produced by the Joule effect is passed in one of the normal ways to the bodies to be heated, namely by conduction, convection, irradiation, according to which is most suitable. In a vacuum for example, thermal energy is spread only by irradiation while, if the source of heat is not in contact with the body to be heated, the only possible ways are by convection and irradiation. Contrary to what is needed for this latter, convection involves movement of fluid substances (liquid or gaseous) between the source of heat and the body to be heated. It is clear that the two effects cannot be completely separated since the panels are in contact with the air, but convection can be reduced in those cases where localised heating is required, namely where radiation is directed towards the body to be heated when placed close to it (for example in applications with infrared lamps for incubators), or where radiation has a direct effect inside the body to be heated (as in the case of microwave ovens). Further, as the amount of mass transport depends on the thermal head between the source and the body to be heated, obviously where heating takes place at relatively low temperatures, the amount of convection is reduced. In the case of radiant panels attempts are made to transfer heat by infrared radiation rather than by convection and for this purpose high-quality conductors are used in the production of heating resistances; because even low values of resistance require very large panels so that heat exchange can take place without having to raise working temperatures too high.

Resistance is an electrical property of materials established by the law of Ohm and is minimum for metals. The specific resistance ρ, or resistivity, is the resistance of a wire of uniform length and cross section at the temperature of 0° C. In practice the section is measured in $mm^2$ and the length in meters. On this basis, for copper we have $\rho=16\times10^{-9}\ \Omega\cdot m$, while for stainless steel it is $\rho=137\times10^{-9}$ (as representative of a range of values).

The known art apparently closest to the panel made according to the present invention is described in the European patent EP 1228669-B1 entitled: "Safety panel for high-efficiency heating by electricity", which is jointly owned by the same Applicant. In view of the many patents there are in this branch of the art, the first claim of the European patent is somewhat more limited compared with initial expectations. The claim is very long and a summary of its main aspects is given here (with partial reference to FIG. 1 of this present description): "Heating device with an electric resistance placed inside a hermetically sealed sandwich-type structure, comprising two rigid elements one of which acts as a heating plate, characterized by the fact that the electric resistance is a serpentine (55) consisting of a strip of highly conductive material of constant width, the ratio between width and thickness being substantially from 10 to 20, formed of a series of U-shaped bends (70-72), crossed by a series of transversal parallel strips (60,61) of mica; said serpentine (55) being placed between two sheets of mica (20, 21) inside the chamber formed by a panel of substantially rectangular shape (10), the result of a base structure substantially shaped like a tray (11) and of one or more closing structures (80, 81) of a similar shape fitted side by side in said base structure (11) . . . (the description goes on to say how the various structures are welded together to make them hermetic and to guarantee sufficient free space inside the chamber to take a quantity of an inflammable gaseous substance for applications in furnaces for polymerizing synthetic resins or for drying paints or inks where there might be a risk of an outbreak of fire)". More particularly, the heating serpentine is obtained from a sheet of copper or brass, 0.5 mm thick, while the containing structure is of metal. Dependent claims cover furnaces or other devices where the above heating panels are applied.

The teaching of the patent cited above, substantially concerns with the particular way the heating serpentine of highly conductive material is made so as to reduce free spaces inside the rectangular hermetic container, as far as possible. This combination of means, while functioning satisfactorily in the short-to-medium term in industrial furnaces where the temperature of the serpentine is not excessively high, approximately below 400° C., has proved unable to maintain its performance in the long term especially where serpentine temperatures are required to exceed the above limit, reaching and exceeding 700° C., as for industrial furnaces in some cases.

The copper serpentine in FIG. 1 is thin and light; it therefore lacks adequate thermal inertia and offers little resistance to internal stresses caused by expansion of the metal when heated. Copper has a high coefficient of linear dilation, which roughly doubles because the thickness of 0.5 mm is negligible in relation to the width of the strip. Differential dilations may therefore occur where imperfections are present, and may lead to dangerous structural deformation.

An analysis of breakdowns following use at very high temperatures has identified systematic breakages in the serpentine in parts at the lower limits of manufacturing tolerances, namely where the cross section of the copper strip is narrower. A second type of breakdown has occurred at the contacts.

The most probable explanation of the first breakdown is that even minimum variations hi the section along the heating serpentine can generate intense mechanical stresses at the corresponding points on the strip and consequently break it because it is so thin. The main cause of the concatenation of effects culminating in breakage lies in the high voltage current circulating in the copper serpentine needed to reach the desired temperature. For example, with a strip of copper 20 m long, 2 cm wide and 0.5 mm thick, made to form 10 bends (consisting of two strips slightly less than 1 in long and spaced at 0.5 cm), a panel is obtained measuring $100\times50\ cm^2$ and having a resistance of about 3.2 mΩ. Assuming electric power of 10 kW, to be supplied to the heating element of a continuous furnace for polymerization, direct current of about 1,770 A is obtained which, however, drops to about 1,250 A because the heat coefficient of the copper at 400° C. almost doubles. A lower value, even only of $1^0/^{00}$ (one per thousand) in the section at a point along the serpentine causes increased resistance of about 3.2μΩ, which would seem negligible but which, on account of the effect produced by the very high voltage, can generate a punctiform increase of thermal power of 5 W. This causes the volume of residual air between the strip and the panel to become overheated which can considerably increase pressure at the position where it occurs. The presence of residual volumes is intrinsic to the serpentine in FIG. 1. The detail reproduced in FIG. 1A (not to scale) in fact shows how volumes V1 and V3 form below the copper strips 70 and 71, and volume V2 above the strip 70. It will be seen that these volumes are caused by the fact that the band of mica 60 bends in order to pass first below and than above the adjacent strips of copper. The alternate bands of mica render the structure rigid avoiding possible short circuits, between adjacent strips, caused by the considerable flexibility of the serpentine and by the small space between strips. It should be remembered that short circuits are harmful because they interfere with the even flow of current and lower overall resistance, necessitating increased current from the generator or lowering temperature in the serpentine if the generator cannot supply the extra current. Another vulnerable part is the short orthogonal arm 70 where there is a local torsion at the corners to allow passage of the band of mica 60.

The structure of the serpentine shown in FIG. 1 lies between two sheets of mica that isolate it from the metal panel. The metal panels at present on the market, like the one referred to, are usually given an outer coating of insulating and thermally protective paint that favours infrared irradiation to the detriment of convection. In the panel seen in FIG. 1, to make up for thermal isolation due to the whole quantity of mica used, a temperature delta must be established in the serpentine, of a value greater than that theoretically required to heat the object placed in the furnace at the desired temperature. If the panel is used at the highest temperatures, the insulating paint peels off systematically with a consequent loss of irradiating power.

Similarly, early wear has appeared at the contacts and also failure, attributable to the effect of high voltage current at the two ends of the serpentine, these being mechanically weaker than the rest of the structure.

Finally, high density of current in the section of the copper wire only 0.5 mm thick constitutes a limitation on the maximum thermal power that can be generated continuously by the single panel. Feed for the single panel with a power of 10 kW signifies a density of current J of about 125 A/mm$^2$ in the section of the serpentine, values that seem excessive for satisfactorily stable operation over a period of time; power would therefore have to be spread over several panels.

The major limitations pointed out for the heating panel disclosed in EP 1228669-B1 are reasonably affecting all heating panels that include flexible resistive serpentines with small thickness, as for example the in-foil ones described in EP 755170-A2 and FR 2580887 A1 limitedly to the same us of heating foods.

SUMMARY OF THE INVENTION

The purpose of the present invention is to overcome the drawbacks encountered in the hermetic radiant panels of the known art when used at the highest working temperatures in industrial furnaces, but also to maintain a high degree of reliability in environmental heating at lower temperatures.

To achieve this purpose, subject of the present invention is a panel for electric heating consisting of a hermetic container inside which is an electric resistance in the shape of a planar serpentine formed of a series of U-shaped bends made in a highly conductive material in the form of a rigid bar, as described in claim 1.

Further advantageous characteristics are described in the dependent claims.

In accordance with the present invention, both the highly conductive material and the width-to-thickness ratio of the bar constituting the serpentine, are chosen by reaching a compromise between the rigidity desirable for the serpentine and the length of the resistor. Preferably the ratio between width and thickness of the metal bar forming the serpentine is less than 3. As an example, it is advantageous to have the serpentine made of steel classified as AISI 304, known as stainless, because of its resistance to wear and its low thermal dilation. Resistivity of this type of steel is $\rho=137\times10^{-9}\Omega\times mm^2/m$ (greater than copper) which makes it possible to obtain values of resistance equal to those of the serpentine in sheet form, keeping the resistor at about the same length, utilizing a bar of a rectangular section of 7.75×5 mm$^2$, that is with a width/thickness ratio of 1.55, a ratio considerably lower than that of the previous serpentine made.

As a second choice, brass can be used for the serpentine, and even copper though the performance of these metals is inferior compared with that of steel. The contact module is a hermetic container higher than the rest of the structure and sealed by special silicon packing at every point that can be opened towards the outside. The module houses contact columns electrically and mechanically connected to the feed wires and screwed to the ends of the serpentine.

The hermetic container panel is an aluminium shell closed uppermost by a flat cover welded at the edges. The shell is given an anodizing treatment in order to form an insulating oxide both inside and outside. The internal oxide isolates the steel serpentine from the shell (in addition to the sheet of mica placed in between); thickness of the external oxide is considerable (80 μm) to improve thermal insulation and favour infrared irradiation. The resistance is fed with low-voltage direct current (e.g. 60 V DC) at a high amperage (e.g. 125 A) of considerable electric power for the single panel (e.g. 7 kW). A three-phase transformer can feed one or more panels to form a baking oven, of a continuous, vertical or horizontal type. Each panel is operated by a three-phase current regulator that reverses the current from alternating to direct. On the rear cover, over the central part of the resistor, there is a type J probe that measures the temperature inside the radiant panel. In this way feed of current to the resistance can be varied according to the desired temperature.

ADVANTAGES OF THE INVENTION

The stainless steel resistance possesses the great merit of having a coefficient of linear thermal dilation ($10.5\times10^{-6}$ C.$^{-1}$) lower than that of a sheet of copper ($2\times17\times10^{-6}$ C$^{-1}$): the serpentine therefore possesses great dimensional stability at the highest temperatures of the furnace, over 400° C., so that, where necessary, it can be made longer to increase the heating surface. The high dimensional stability greatly reduces mechanical stress on the resistance and thus prolongs its life.

As the conductor has such a large cross section (about 40 mm$^2$) it can be used to feed the single panel with high voltage current capable of generating high thermal power. Contacts are electrically and mechanically stable even using the highest voltages Overall, the structure made according to the invention is much heavier (about 8 kg) and has greater rigidity compared with those presently known; it is therefore better able to undertake heavy work at the highest operating temperatures, which may reach 700° C., since it can withstand the effect of possible internal stresses due to thermal dilation and to residual working tolerances. In this connection, contrary to the serpentine seen in FIG. 1A where the horizontal parts lie on parallel planes, the serpentine according to the present invention is a completely planar structure in which insulation between adjacent conductors consists of strips inserted for greater safety. Internal volumes such as V1, V2 and V3, seen above and below the conductors and able to augment the negative effects of constructional imperfections, are no longer present. Such imperfections have been reduced to a minimum by cutting out the profile of the serpentine from a sheet of steel of the desired thickness, using a punctiform jet of water at very high pressure. This sophisticated technique lessens overheating during the cutting process and ensures an excellent degree of precision for the profile of the resistance. In turn, a profile of such precision ensures the best possible distribution of heat and avoids dangerous spot overheating.

While the panels produced by the art at present in use, coated with a layer of protective paint which may peel off at the highest working temperatures, with the panel according to the invention this risk is avoided thanks to the thick layer of oxide firmly bonded to the radiant surface of the structure of which it forms an integral part.

It is an advantage that the colour of the oxide formed by anodizing tends to become black, according to the thickness. The thick layer of oxide present on the invented panel makes it closely akin to an ideal radiator according to Planck's formula. This is usually represented by a series of bell-shaped curves placed one over another in the order of absolute temperature (° K.), the ordinate of each one having a quantity of energy irradiated by the ideal black body in accordance with the $\lambda$ wavelength of emitted radiation. The maximum point moves from one curve to another as temperature falls towards increasing $\lambda$ values, in other words towards increasingly lower frequencies in the infrared (from $10^{-3}$ to 0.8 μm). At the serpentine's highest working temperature, fixed without any limitation at 700° C. (973.15° K.), the maximum radiation emitted is $\lambda$=2.96 comprised in the infra-red spectrum; following the bell-shaped curve it is seen that a small part of the radiation emitted shows a wavelength comprised in the narrow interval of the spectrum visible (from 0.76 to 0.38 μm), so that, where visible, the serpentine would appear reddish.

Although the greatest advantages are obtainable at the highest temperatures, the irradiating panel according to the invention has the advantage of being suitable for environmental heating as well, at considerably lower temperatures. In this case the advantage is seen in its great operational reliability over time.

SHORT DESCRIPTION OF THE FIGURES

Further purposes and advantages of the present invention will become clear from the following detailed description of an example of its realization, and from the attached drawings given for explanatory purposes and which are in no way limiting, wherein:

FIG. 1, already described, shows a part of a resistive serpentine made according to the presently known art;

FIG. 1*a*, already described, shows a detail of FIG. 1;

DETAILED DESCRIPTION OF A PREFERRED REALIZATION OF THE INVENTION

Figure 1:
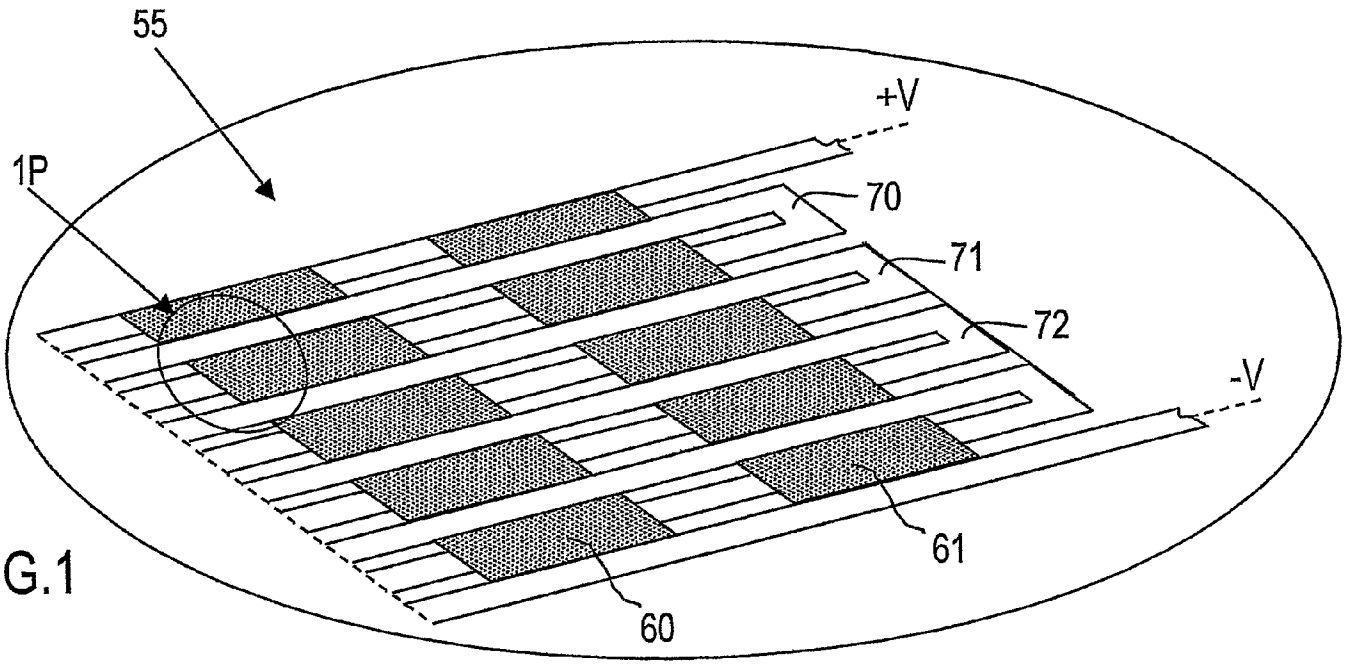
Figure 1A:
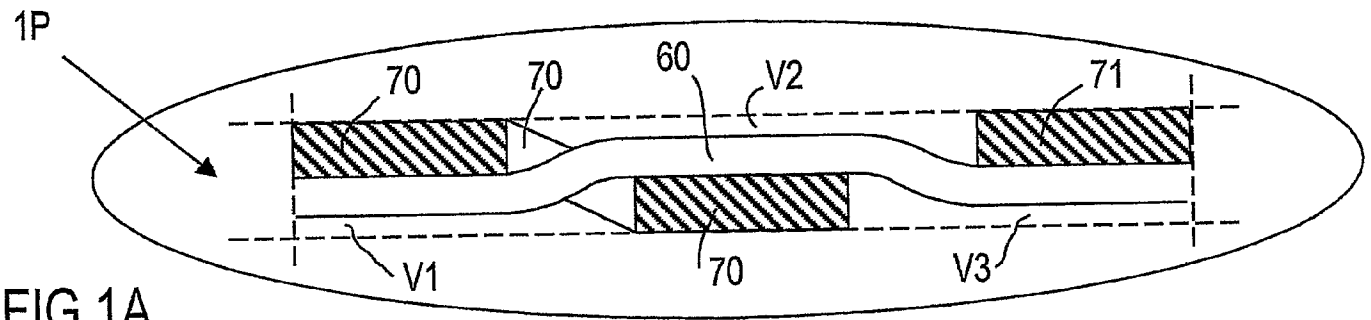
Figure 2:
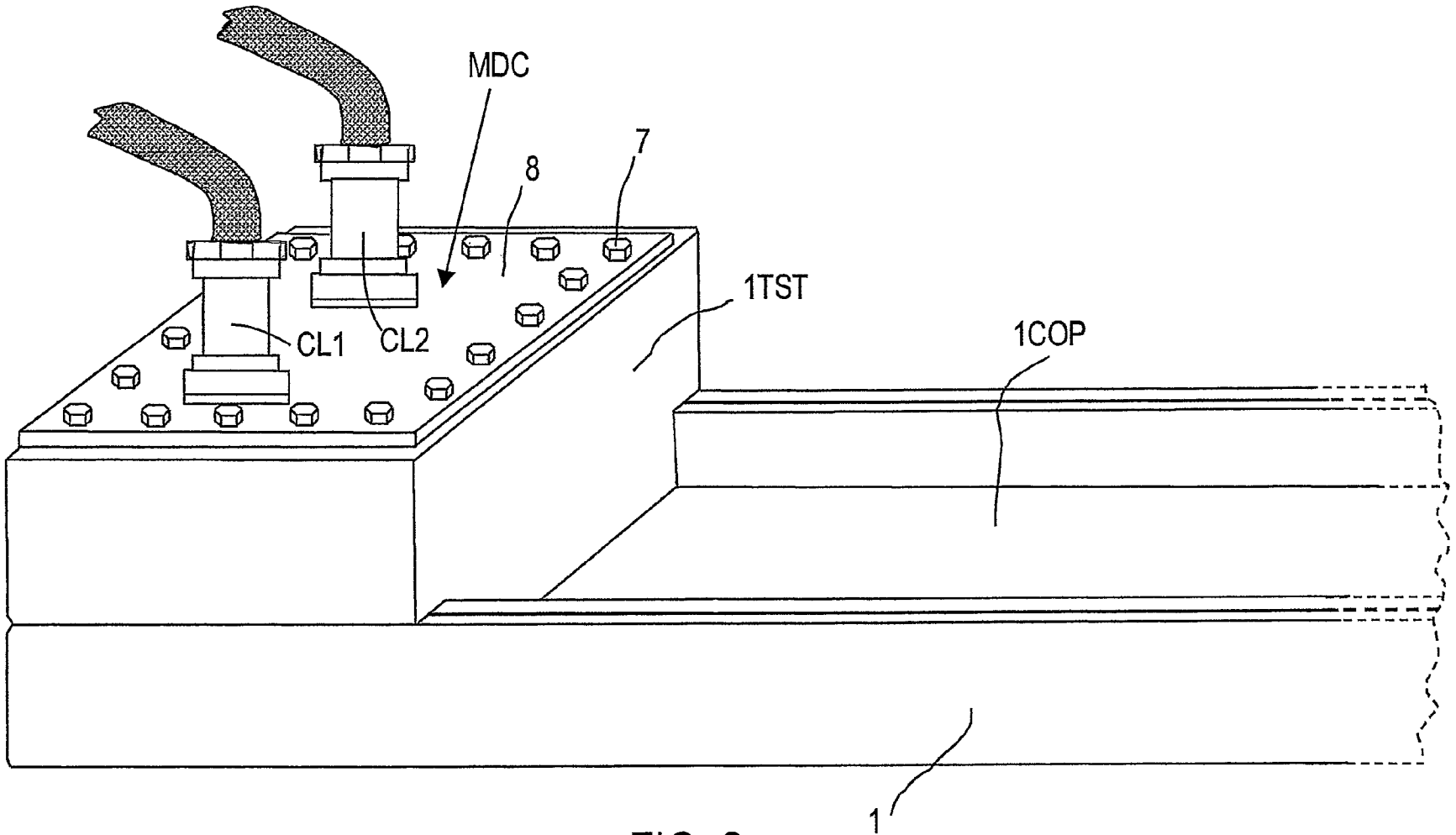
FIG. 2, is a partial perspective view of the rear side of the electric heating panel according to the present invention, showing the end of the panel comprising a contact module from which emerge the feed wires leading to the generator.

FIG. 2 shows an electric heating panel comprising a metal shell 1 of a substantially rectangular shape, extended lengthwise and closed uppermost by a cover 1COP bent back onto the lateral edges in contact with the internal walls of the shell 1 where it is welded along its whole length. At the end, not seen, the cover 1COP is welded to the shell 1 along the shorter side. The visible end of the shell 1 extends beyond the cover 1COP to support a connector module MDC, parallelepiped in shape, of the same width as the shell 1 but much shorter. A plate 8, acting as a cover, is fixed to the edges of a rectangular opening in the upper wall of the MDC module by a crown of peripheral screws 7. Standing up on the plate 8 are two cylindrical columns CL1 and CL2 carrying wires, aligned along the transversal axis of symmetry. Emerging from the columns are two thick electric cables connected to a generator of direct current (not seen in the figure). The connector module MDC is welded to the shell 1 all round its surrounding edges and along the edge of one lateral wall 1TST; this latter is also welded to the cover 1COP thus closing the panel on this side. All these welds ensure that the rear of the panel shown in the figure is hermetically sealed. The shell 1, the cover 1COP, the contact module MDC, the plate 8 and the turrets CL1 and CL2 are all of aluminium; the screws 7 are galvanized.

Figures 3, 4, 5:
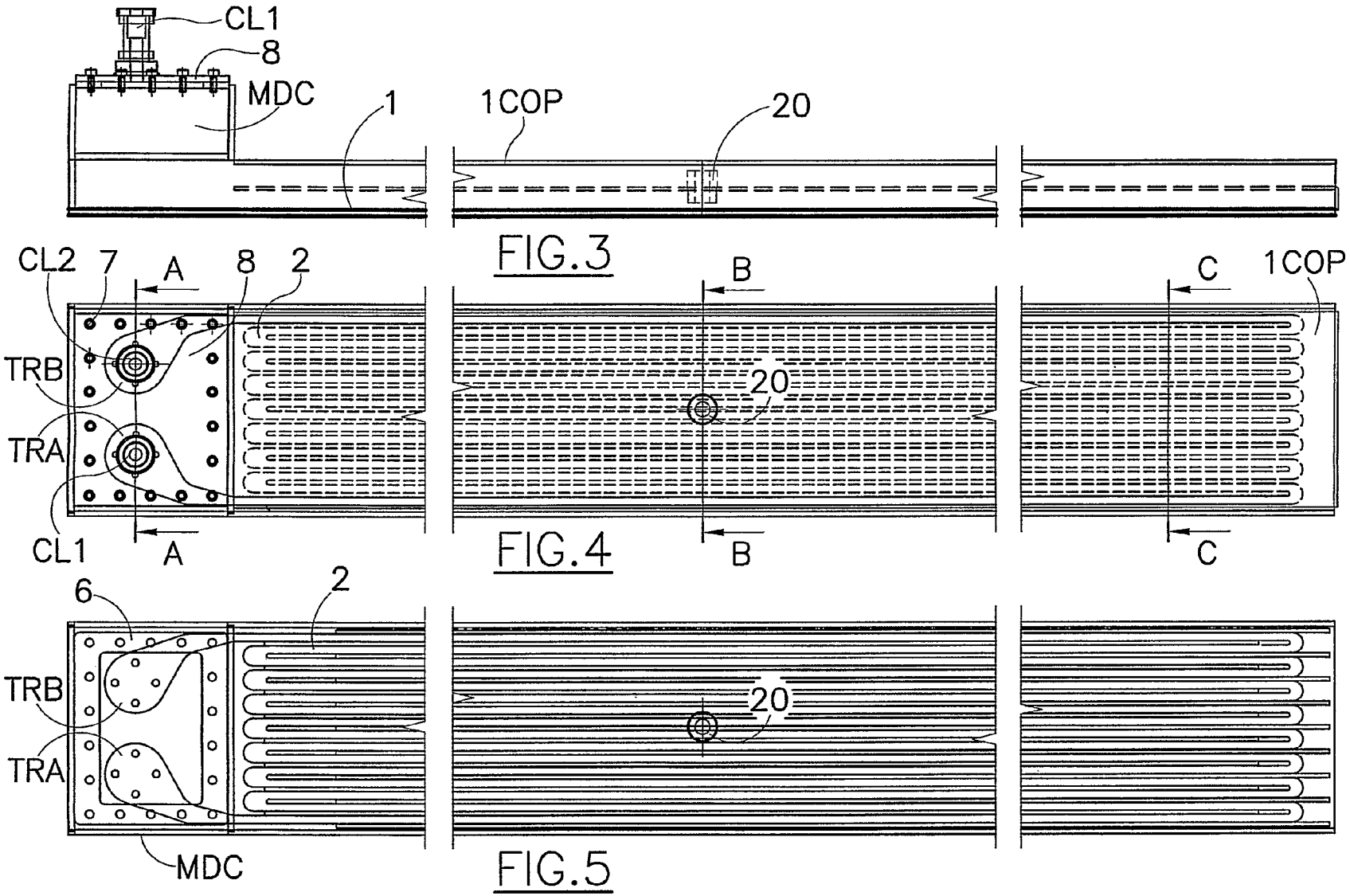
FIG. 3 is a profile view of the panel in FIG. 2.
FIG. 4 is a plan view of the panel in FIG. 2 when closed, but indicates the resistive serpentine by a dotted line.
FIG. 5 is a plan view of the panel in FIG. 2, open at the rear to show the inside of the serpentine.

FIG. 3 shows a side view of the panel in FIG. 2, with a probe holder 20, indicated by a traced line, in an approximately central position. A heavily marked line running the whole length of the underside of the shell 1 represents a layer of aluminium oxide about 80 μm thick that completely covers the face from which heat passes out.

FIG. 4 shows by traced lines a serpentine-shaped resistance 2 placed in the shell 1. The serpentine 2 has two ends TRA, TRB, one opposite the other that extend to a three-quarters circular form (hereinafter called pseudo-circular) inside the contact module MDC. A hole is marked at the position of the probe holder 20. Three axis lines, respectively A-A, B-B and C-C are drawn along the shell 1 marking the position of the cross sections in FIGS. 6, 7 and 8. FIG. 5 shows the resistive serpentine 2 formed of 8 greatly elongated U-shaped bends. A spacer strip of mica is placed between each pair of adjacent conductors placed at 4.25 mm one from another. Four holes for electric contact screws can be seen on the pseudo-circular ends TRA, TRB of the serpentine 2. A special kind of glass and silicon packing 6 is also shown, placed under the plate 8 to ensure that the panel is hermetically sealed. The serpentine 2 consists of a single conductor of AISI 304 steel in the form of a rectangular bar 25 m long, 7.75 mm wide, 5 mm thick, weighing about 8 kg, made by cutting a sheet with extreme precision as already described. The serpentine's overall resistance is 0.471Ω obtained with a resistivity of $\rho=137\times10^{-9}\Omega\times mm^2/m$ and with the dimensions as specified.

Figure 6:
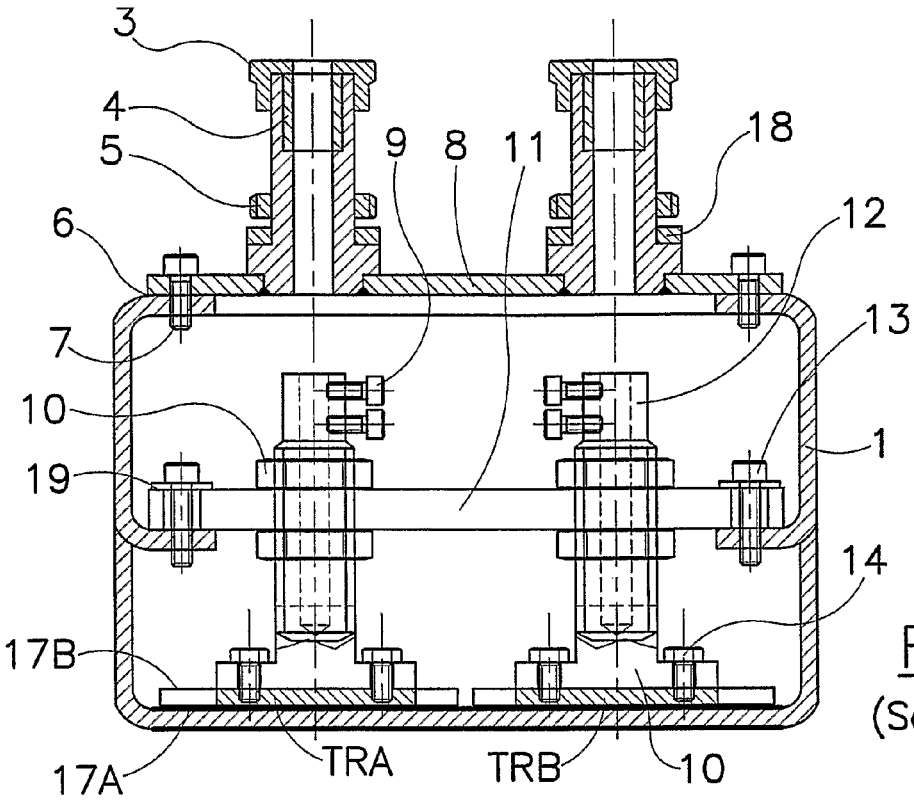
FIG. 6 shows a section of the contact module, cut through along the plane A-A in FIG. 4.

FIG. 6 illustrates the contact module MDC cut through along the axis A-A in FIG. 4. The figure shows that this module stands at one end of the shell 1 sharing and increasing the internal space by a lower rectangular opening that leaves an indented surrounding edge welded to the rim of the shell 1. Screwed to this edge by screws 13, and fixed transversally in a central position, is an intermediate support 11 of thick thermally and electrically insulating material of high thermal resistance. Two hollow brass contact columns 12 penetrate inside two holes in the insulating support 11, to which they are fixed by respective pairs of nuts 10 screwed to the columns 12 from opposite sides of the insulating support 11. The contact columns each terminate on a circular base of greater diameter, in contact with its respective pseudo-circular end TRA, TRB of the resistance 2, through an interposed sheet of mica 17B that extends over the whole internal surface of the panel. The circular bases of the contact columns 12 are screwed into the ends TRA, TRB with four stainless steel screws 14 thus completing electrical contact. A second sheet 17A of mica is laid under the ends TRA, TRB and under the whole of the serpentine 2.

In the cover 8 are two holes aligned on the axis of the contact columns 12 into which are fitted two hollow cable holders CL1 and CL2, their lower circular edges being welded to the cover 8. At the free end of said columns CL1 and CL2 is a silicon rubber seal 4 with a ring nut 3 to hold the cables. A galvanized ring nut is present in the ends of columns CL1 and CL2.

The electric cables complete with sheaths are fitted into place in columns CL1 and CL2 with the cover 8 raised, then slid inside until they reach the contact columns 12 into which the short bare end of the central conductor is inserted and held fast by the two galvanized screws 9 that penetrate into the wall of each contact column 12. The cover is then screwed down onto the upper edge of the MDC module after inserting the glass and silicon packing 6. The hermetic seal of the MDC module is ensured by parts 4 and 6 and by the welding round the edges.

Figure 7:
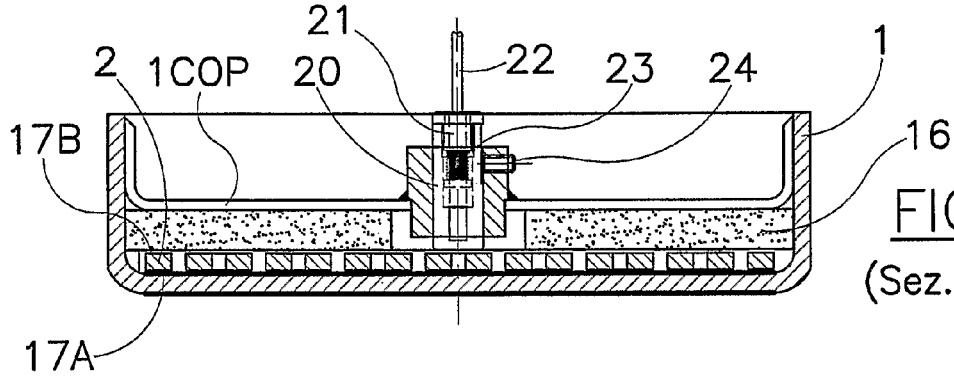
FIG. 7 is a section view of the panel along the plane B-B in FIG. 4 at the position of a temperature probe.
Figure 8:
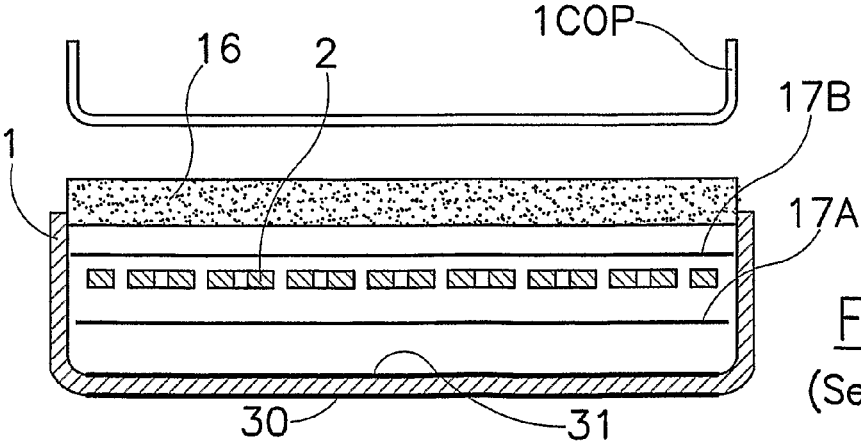
FIG. 8 is an exploded view of the section along plane C-C in FIG. 4.

FIG. 7 shows a section of the panel along the axis B-B in FIG. 4. With reference to FIG. 7 and also to the exploded view in FIG. 8 showing the section along axis C-C, the aluminium covering will be seen comprising the shell 1 and the cover 1COP. The shell 1 is an extruded channel-shaped piece with a flat bottom and low sides, closed at each end by welded walls. Its dimensions are approximately: 210 mm in width, 1,770 mm in length and 54 mm in height. The cover 1COP is the same shape as the shell 1 though lower and slightly narrower so that, in the final stage of assembly, it can be fitted on with its side walls in contact with the internal walls of the shell 1 and be welded round the edges. Both the shell 1 and the cover 1COP can be made by bending aluminium sheeting of suitable width and thickness, or by extrusion.

The base wall of the shell 1 presents two layers of oxide 30 and 31 (FIG. 8), one internal and one external; thickness of the external layer 30 is 80 μm, thicker than layer 31. On the inside of the shell 1 a sheet of mica 17A is laid in contact with the surface of the base; the resistive serpentine 2 is laid on the sheet 17A and over the serpentine is laid a second sheet of mica 17B on top of which is a thermal and electrical insulating layer 16. The cover 1COP is placed in contact with the insulating layer 16 when then closes the panel. Overall thickness of all layers in contact, extending over the whole possible length, is only 29 mm.

At a central position in the figure is a J-type temperature probe 22 fitted into a probe holder 20 that penetrates in a hole made for it in the cover 1COP and into the thermal insulating layer 16 till it reaches the sheet of mica 17B. The probe holder 20 houses a small axial cylinder inside which is a spring 23 in contact with a hexagonally headed plug 21 from which emerges the shank of the probe 22. A minute screw 24 enters the wall of the sleeve 20 to lock the small internal cylinder and probe. The temperature probe 22 is connected by an electric wire (not shown in the figure) to a system for regulating current inside the serpentine 2.

As the internal layer of oxide 31 is a good electrical insulator, during operation it insulates the metal serpentine 2 from the shell 1 and in so doing makes insulation by the sheet of mica 17A more reliable. Suitably heated by the current in circulation, the resistive serpentine 2 conducts heat mainly onto the inner surface of the shell 1 since conduction towards the cover 1COP is hindered by the thick thermal insulating layer 16. Heat absorbed by the aluminium of the shell 1 spreads from the outer surface of the shell towards the body, or the environment, to be heated. Diffusion is mainly effected by irradiation of infrared rays from the outer lay of oxide 30.

The layers of oxide 30 and 31 are obtained by a "hard" anodic process of oxidation. This is an electrolytic process carried out at a low temperature during which a layer of aluminium oxide is formed on the surface of the aluminium sheet treated inside by partial penetration. With this type of treatment the aluminium can be used under the most difficult operative conditions, guaranteeing structural resistance at high temperatures (up to 2,000° C. for short periods of exposure). Hard anodic oxidation also causes the treated layer to darken in colour, gradually tending towards black according to the thickness of the oxide. Thermal conductivity is approximately from one tenth to one thirtieth of that of the basic aluminium; in this way, as the thickness of the oxide layer increases, the radiating surface's emissivity also increases approaching that of the "black body" considered ideal. Since the thickness of the inner layer of oxide 31 is a fraction of that of the outer layer 30, the inner oxide layer 31 does not significantly hinder transmission of heat from the serpentine 2 to the base of the shell 1.

It is clear, from the description given of realization of a preferred example, that a number of changes can be introduced without thereby departing from the present invention in every form that can be produced in accordance with the description and the following claims.

The invention claimed is:

1. A panel for electric heating, comprised of a hermetically sealed container, comprising:

a shell (1) having a substantially rectangular metallic base;

a metallic cover (1COP), inside which is an electric resistance in the shape of a substantially planar serpentine (2) formed of a series of U-shaped bends of highly conductive material, electrically insulated from the container by interposition of electrically insulating material (17A, 17B) in contact with the serpentine (2) and, respectively, with the shell (1) and cover (1COP), minimizing the internal free spaces, the highly conductive material formed as a rigid bar (2), and ends of the rigid bar extend beyond the serpentine itself and widen to assume a pseudo-circular shape (TRA, TRB) for connection to means of contact (14, 12) connectable to feed wires; and an hermetic contact module (MDC), inside which said means of contact (12, 14) and said pseudo-circular endings (TRA, TRB) are housed, said means of contact being in communication with one end of said shell (1) and with said pseudo-circular endings (TRA, TRB) of said serpentine (2), wherein said means of contact (12, 14) include two electrically conducting contact columns (12), hollow inside, for inserting and connecting a respective feed wire, screwed to a respective pseudo-circular ending (TRA, TRB) of said serpentine (2) with a circular base wider than a shank (14) of said means of contact.

2. The panel according to claim 1, wherein said feed wires come in contact with said contact columns (12) through a cover (8) screwed to the edges of an opening in the wall opposite the base of the shell (1), provided with two holes for receiving hermetic wire holders (CL1, CL2, 4, 1).

3. The panel according to claim 1, wherein said metallic shell (1) is welded to said metallic cover (1COP) for closing the container hermetically.

4. The panel according to claim 1, wherein said highly conductive material is steel known as stainless steel, preferably that classified as AISI 304.

5. The panel according to claim 1, wherein said rigid bar has constant rectangular cross-section (2) and a ratio between width and thickness less than 3.

6. The panel according to claim 5, wherein said bar constituting the serpentine (2) is about 20 m. long.

7. The panel according to claim 6, wherein said serpentine (2) comprises adjacent parallel conductors separated by approximately the width of said bar (2).

8. The panel according to claim 1, wherein the profile of said serpentine (2) is a high precision profile obtained by cutting a sheet of metal by a punctiform jet of water at very high pressure.

9. The panel according to claim 1, wherein said hermetic container is of aluminium and that the outer surface of the base of said shell (1) incorporates a thick layer of anodized oxide (30) of a mainly black colour, uniformly spread over the whole of the base to facilitate infrared irradiation.

10. The panel according to claim 9, wherein said layer of aluminium oxide (30) is about 80 μm thick and is also applied to the inner surface of said base to form a second and thinner layer (31).

11. The panel according to claim 1, wherein that between said cover (1COP) and said serpentine (2) is a layer of thermally insulating layer (16).

12. The panel according to claim 1, wherein placed between each pair of adjacent conductors in said serpentine (2) is a spacer strip of electrically insulating material.

13. The panel according to claim 1, further comprising:

a temperature probe (22) placed close to said rigid bar (2) through said metallic cover (1COP) and said thermal insulating layer (16).

14. The panel according to claim 13, wherein said temperature probe (22) is connected by an electric wire to a system of current regulation inside the serpentine (29).

* * * * *